US007044028B1

(12) United States Patent
Lozano et al.

(10) Patent No.: US 7,044,028 B1
(45) Date of Patent: May 16, 2006

(54) SOCKET WRENCH APPARATUS

(76) Inventors: Miguel Lozano, 12325 N. El Frio St., El Mirage, AZ (US) 85335; Jesus Gomez, 13121 W. Sierra Vista, Glendale, AZ (US) 85307

( * ) Notice: Subject to any disclaimer, the term of this patent is extended or adjusted under 35 U.S.C. 154(b) by 0 days.

(21) Appl. No.: 10/819,062

(22) Filed: Apr. 6, 2004

(51) Int. Cl.
*B25B 13/46* (2006.01)
*B25B 23/16* (2006.01)

(52) U.S. Cl. ..... 81/60; 81/177.2; 81/177.1; 81/177.85

(58) Field of Classification Search ..... 81/58–62, 81/177.1, 177.2, 177.85, 125.1, 180.1; 7/138
See application file for complete search history.

(56) References Cited

U.S. PATENT DOCUMENTS 1,435,288 A * 11/1922 Gifford et al. ..... 81/58.3
3,735,434 A * 5/1973 Penberthy ..... 7/158
4,596,167 A * 6/1986 White, Jr. ..... 81/177.2
4,787,277 A * 11/1988 Myers ..... 81/179
5,522,287 A * 6/1996 Chiang ..... 81/60
5,526,723 A 6/1996 Sormunen et al.
D372,409 S 8/1996 Wright et al.
D386,656 S 11/1997 Kyser
6,112,625 A * 9/2000 Turtle ..... 81/177.2
6,167,787 B1 * 1/2001 Jarvis ..... 81/177.2
6,336,382 B1 * 1/2002 Cerda ..... 81/60
6,378,400 B1 4/2002 Bogli
6,523,441 B1 2/2003 Lee

* cited by examiner

*Primary Examiner*—Debra S Meislin

(57) ABSTRACT

A socket wrench apparatus for applying enhanced torque having a first ratchet head which has a first ratchet mechanism therein and a first rotatable generally rectangular drive outwardly extending from the first ratchet mechanism. A first tubular handle is connected to the first ratchet head. The first tubular handle terminates at a first free distal end. The first free distal end has a square hole therein.

10 Claims, 3 Drawing Sheets

SOCKET WRENCH APPARATUS

BACKGROUND OF THE INVENTION

1. Field of the Invention

The present embodiment of the invention relates to a socket wrench apparatus for use in connection with socket wrenches. The socket wrench apparatus has particular utility in connection with socket wrenches having handle extensions.

2. Description of the Prior Art

Socket wrench apparatus are desirable for work requiring the tightening or loosening of bolts or nuts. A need was felt for a socket wrench apparatus having a handle to which standard extensions could be detachably connected to extend the torque transmission of the wrench.

The use of socket wrenches is known in the prior art. For example, U.S. patent application No. 2002/0078800 to Li discloses a socket wrench extension with improved torque transmission includes a main body having a first end to be releasably engaged with a socket wrench and a second end. A driving column is formed on the second end of the main body so as to be releasably engaged with a socket. The driving column includes a recessed section defined in a periphery thereof adjacent to the second end of the main body, and a shoulder is defined between the recessed section and the second end of the main body. The socket may be engaged with the recessed section of the socket wrench extension to allow angular joint therebetween for operation in a difficult-to-operate condition. However, the Li '800 patent does not have a female square hole in the handle portion of the wrench, nor does it have a male square head forming the handle portion of the wrench.

Similarly, U.S. Pat. No. 6,112,625 to Turtle discloses an extension bar for tool includes a wrench head with a swivel adapter, a combination handle and extension bar attachable to the swivel adapter, and a ratchet head. The wrench head includes a tubular member with a longitudinal slot, and an internal C-shaped brace dividing the tubular member into two sockets at opposite ends thereof One socket includes six sides and five points, and the other socket includes twenty sides and ten points, so that both sockets can securely grip all six sides of a nut or bolt. The points of one socket are offset radially relative to the points of the other socket for providing smaller increments in repositioning freedom. The swivel adapter is pivotally attached between a pair of ears on the wrench head by a removable pin, so that it can be removed and attached between a like pair of ears on the ratchet head. The extension bar includes a female end with a faceted outer surface that prevents it from rolling on a slanted surface, and also enables the extension bar to be gripped and turned by a conventional wrench. However, the Turtle '625 patent does not have a female square hole in the handle portion of the wrench, nor does it have a male square head forming the handle portion of the wrench.

Likewise, U.S. Pat. No. 6,523,441 to Lee discloses a switch device of a socket wrench extension includes a connecting shank formed with an axial circular hole receiving a restoring member and a drive rod, and a radial hole receiving a positioning ball. The drive rod has a tapered face and an insertion recess. A drive block is received in a radial oblong slot of the connecting shank, and has an insertion block that may be inserted into the insertion recess of the drive rod. The drive block has a spring recess receiving a spring and a positioning pin. A control ring mounted on the connecting shank may move the drive block and the drive rod, whereby the positioning ball may be moved along the tapered face to sink into the radial hole, so that the connecting shank can be detached from the socket easily and quickly. However, the Lee '441 patent does not have a female square hole in the handle portion of the wrench, nor does it have a male square head forming the handle portion of the wrench.

Correspondingly, U.S. Pat. No. 5,526,723 to Sormunen et al. discloses a universal striking tool with exchangeable tool bits for use when center-punching, driving cotter pins and nail heads and driving in clips of various kinds, i.e. for such activities where today a hammer is used for striking a separate thumb-grip held object or separate, thumb-grip held tools. A handle, which has at least at one end is equipped with an at least in one plane pivotably arranged driver head socket, to which a driver head is attached, said driver head socket being pivotably and lockably arranged in the handle. Exchangeable striking tool bits for different work assignments are easily fitted to the driver head, and extra tool bits are magazined in the handle. However, the Sormunen et al. '723 patent does not have a female square hole in the handle portion of the wrench, nor does it have a male square head forming the handle portion of the wrench.

Further, U.S. Pat. No. Des. 386,656 to Kyser discloses a wrench extension. However, the Kyser '656 patent does not have a female square hole in the handle portion of the wrench, nor does it have a male square head forming the handle portion of the wrench.

Further yet, U.S. Pat. No. Des. 372,409 to Wright et al. discloses a double-ended flex handle wrench. However, the Wright et al. '409 patent does not have a female square hole in the handle portion of the wrench, nor does it have a male square head forming the handle portion of the wrench.

Still further, U.S. Pat. No. 6,378,400 to Bogli discloses a detachable handle socket ratchet wrench system for permitting a user to change handles to suit the needs of the user. The detachable handle socket ratchet wrench system includes a ratchet head with a tubular sleeve outwardly extending therefrom defining a receptacle. A plurality of elongate handles are provided each having an insertion portion adjacent a distal end of the respective handle. The insertion portion of each of the handles is insertable into the receptacle of the sleeve. Each of the handle has a length defined between the proximal and distal ends of the respective handle. The length of a first of the handles is greater than the length of a second of the handles and at least two times greater than the length of a third of the handles. The length of the third handle is greater than about one-half the length of the second handle and less than about four-fifths the length of the second handle. However, the Bogli '400 patent does not have a female square hole in the handle portion of the wrench, nor does it have a male square head forming the handle portion of the wrench.

Yet further still, U.S. Pat. No. 5,904,077 to Wright et al. discloses a double-ended flex-handle wrench having a pivotable tool head at each end thereof, the tool head having a locking-type retaining device for locking a gripping member to the tool head. However, the Wright et al. '077 patent does not have a female square hole in the handle portion of the wrench, nor does it have a male square head forming the handle portion of the wrench.

Lastly, U.S. Pat. No. 6,035,747 to Valela discloses an extension bar that has a cylindrical hollow shaft that has two solid ends for use with socket type wrenches. At one end, a solid piece of metal is machined to a post to receive the socket. At the other end, the solid member has a recess formed in it to receive the post of the socket wrench. Unlike the extension bars available today, the recess for the socket wrench does not penetrate into the hollow shaft. This construction, unlike the others, prevents the extension from twisting when torque is applied by the wrench. Instead of having to overcome the twisting force before torque is applied to a fastener, the torque is transmitted directly to the fastener. This type of extension bar can be made in any length, even three or four feet. Even at those lengths, the extension does not twist. As a result, repair operations are faster and safer. However, the Valela '747 patent does not have a female square hole in the handle portion of the wrench, nor does it have a male square head forming the handle portion of the wrench.

While the above-described devices fulfill their respective, particular objectives and requirements, the aforementioned patents do not describe a socket wrench apparatus that allows socket wrenches having handle extensions. The Li '800, Turtle '625, Lee '441, Sormunen et al. '723, Kyser '656, Bogli '400, Wright et al. '077 and Valela '747 patents make no provision for a female square hole in the handle portion of the wrench, nor does it have a male square head forming the handle portion of the wrench.

Therefore, a need exists for a new and improved socket wrench apparatus which can be used for socket wrenches having handle extensions. In this regard, the present embodiment of the invention substantially fulfills this need. In this respect, the socket wrench apparatus according to the present embodiment of the invention substantially departs from the conventional concepts and designs of the prior art, and in doing so provides an apparatus primarily developed for the purpose of socket wrenches having handle extensions.

SUMMARY OF THE INVENTION

In view of the foregoing disadvantages inherent in the known types of socket wrenches now present in the prior art, the present embodiment of the invention provides an improved socket wrench apparatus, and overcomes the above-mentioned disadvantages and drawbacks of the prior art. As such, the general purpose of the present embodiment of the invention, which will be described subsequently in greater detail, is to provide a new and improved socket wrench apparatus and method which has all the advantages of the prior art mentioned heretofore and many novel features that result in a socket wrench apparatus which is not anticipated, rendered obvious, suggested, or even implied by the prior art, either alone or in any combination thereof To attain this, the present embodiment of the invention essentially comprises a first ratchet head which has a first ratchet mechanism therein and a first rotatable generally rectangular drive outwardly extending from the first ratchet mechanism. A first tubular handle is connected to the first ratchet head. The first tubular handle terminates at a first free distal end. The first free distal end has a square hole therein.

There has thus been outlined, rather broadly, the more important features of the embodiment of the invention in order that the detailed description thereof that follows may be better understood and in order that the present contribution to the art may be better appreciated.

The present embodiment of the invention may also include a second ratchet head, a second tubular handle, an elongate extension and an alignment spike. There are, of course, additional features of the present embodiment of the invention that will be described hereinafter and which will form the subject matter of the claims attached.

Numerous objects, features and advantages of the present embodiment of the invention will be readily apparent to those of ordinary skill in the art upon a reading of the following detailed description of presently preferred, but nonetheless illustrative, embodiments of the present embodiment of the invention when taken in conjunction with the accompanying drawings. In this respect, before explaining the current embodiment of the embodiment of the invention in detail, it is to be understood that the embodiment of the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present embodiment of the invention.

It is therefore an object of the present embodiment of the invention to provide a new and improved socket wrench apparatus that has all of the advantages of the prior art socket wrenches and none of the disadvantages.

It is another object of the present embodiment of the invention to provide a new and improved socket wrench apparatus that may be easily and efficiently manufactured and marketed.

An even further object of the present embodiment of the invention is to provide a new and improved socket wrench apparatus that has a low cost of manufacture with regard to both materials and labor, and which accordingly is then susceptible of low prices of sale to the consuming public, thereby making such socket wrench apparatus economically available to the buying public.

Still another object of the present embodiment of the invention is to provide a new socket wrench apparatus that provides in the apparatuses and methods of the prior art some of the advantages thereof, while simultaneously overcoming some of the disadvantages normally associated therewith.

Even still another object of the present embodiment of the invention is to provide a socket wrench apparatus for socket wrenches handle having a square hole therein.

Lastly, it is an object of the present embodiment of the invention is to provide a socket wrench apparatus for socket wrenches having a square socket extension.

These together with other objects of the embodiment of the invention, along with the various features of novelty that characterize the embodiment of the invention, are pointed out with particularity in the claims annexed to and forming a part of this disclosure. For a better understanding of the embodiment of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The embodiment of the invention will be better understood and objects other than those set forth above will become apparent when consideration is given to the following detailed description thereof Such description makes reference to the annexed drawings wherein.

The same reference numerals refer to the same parts throughout the various figures.

DESCRIPTION OF THE PREFERRED EMBODIMENT

Figure 1:
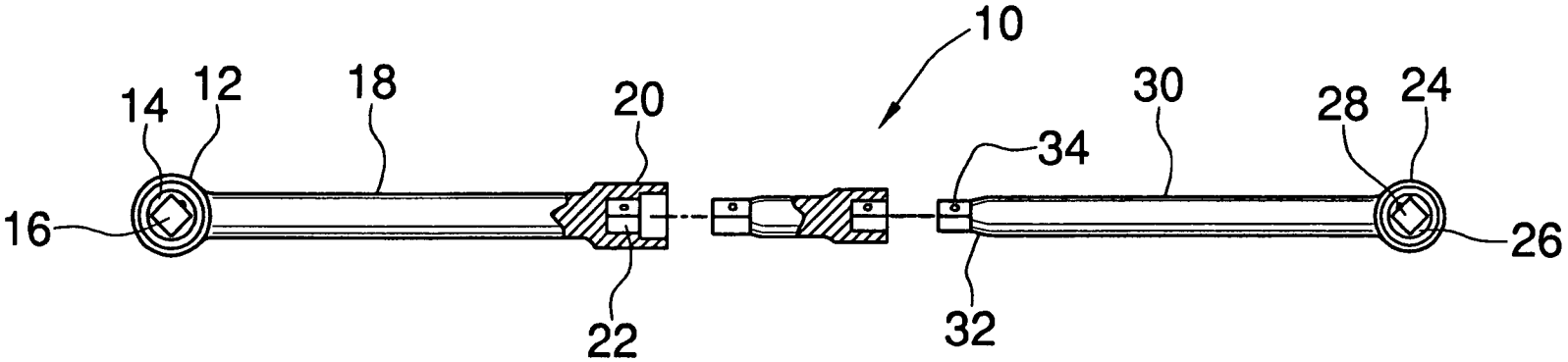
FIG. 1 is a front side view of the preferred embodiment of the socket wrench apparatus constructed in accordance with the principles of the present invention.

Referring now to the drawings, and particularly to FIGS. 1–4, a preferred embodiment of the socket wrench apparatus of the present invention is shown and generally designated by the reference numeral 10.

In FIG. 1, a new and improved socket wrench apparatus 10 of the present invention for socket wrenches having handle extensions is illustrated and will be described. More particularly, the socket wrench apparatus 10 has a first ratchet head 12 having a first ratchet mechanism 14 therein and a first rotatable generally rectangular drive 16 outwardly extending from the first ratchet mechanism 14. The first ratchet head 12 is ⅜ inch standard drive in the present embodiment. In alternative embodiments, the first ratchet head may be ½, ¾ or one inch standard drives. The first ratchet head 12 is comprised of tool steel in the present embodiment. The first ratchet head 12 may be comprised of stainless steel in alternative embodiments. A first tubular handle 18 is connected to the first ratchet head 12. The first tubular handle 18 terminates at a first free distal end 20, which is distal to said first ratchet head 12. The first free distal end 20 has a square hole therein 22. A second ratchet head 24 has a second ratchet mechanism 26 therein and a second rotatable generally rectangular drive 28 outwardly extending from the second ratchet mechanism 26. A second tubular handle 30 is connected to the second ratchet head 24. The second tubular handle 30 terminates at a second free distal end 32, which is distal to said second ratchet head 24. The second tubular handle second free distal end 32 has a generally square extension 34 complementary to the first tubular handle square hole 22 for detachable connection thereto.

Figure 2:
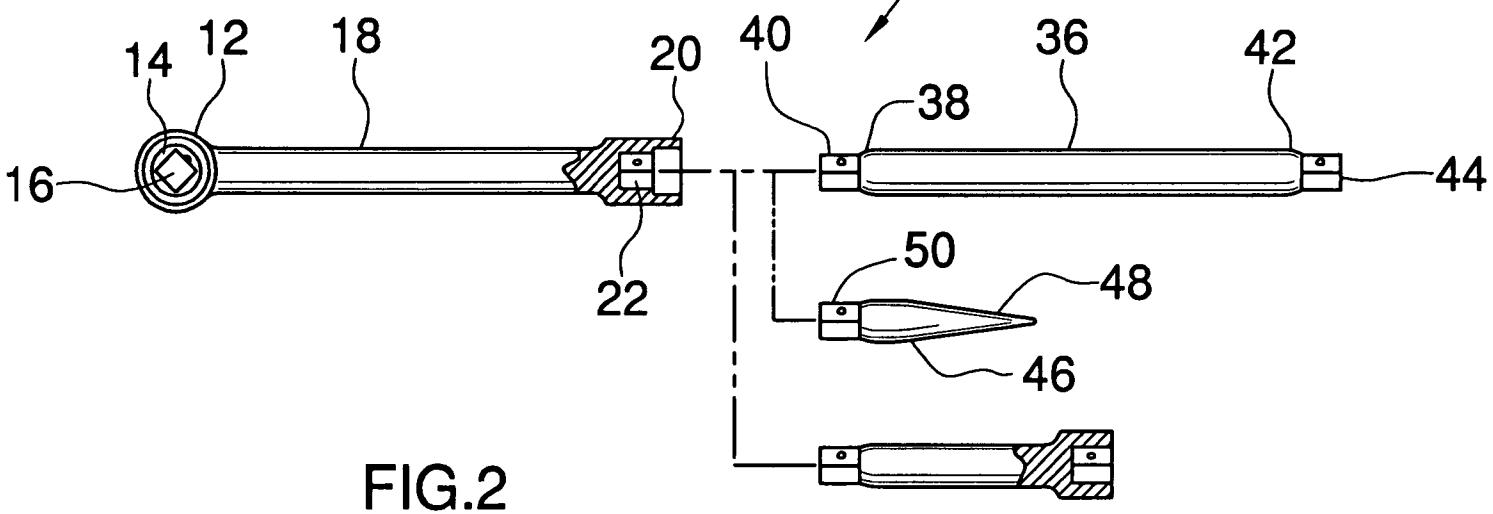
FIG. 2 is a front side view of the socket wrench apparatus of the present embodiment of the invention.
Figure 3:
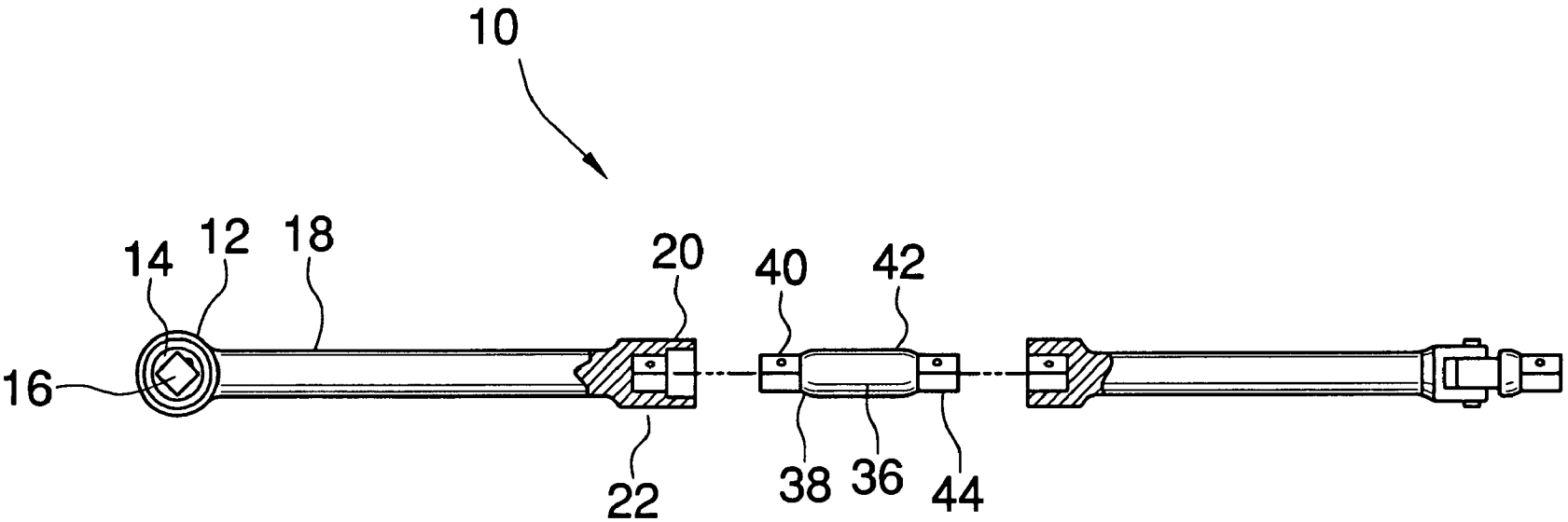
FIG. 3 is a front side view of the socket wrench apparatus of the present embodiment of the invention.

In FIG. 2, the socket wrench apparatus is illustrated and will be described. More particularly, the socket wrench apparatus 10 has the first ratchet head 12 having the first ratchet mechanism 14 therein and the first rotatable generally rectangular drive 16 outwardly extending from the first ratchet mechanism 14. The first ratchet head 12 is ⅜ inch standard drive. The first ratchet head 12 is comprised of tool steel. The first tubular handle 18 is connected to the first ratchet head 12. The first tubular handle 18 terminates at the first free distal end 20. The first free distal end 20 has the square hole therein 22. An elongate extension 36 has a first end 38 and a second end 42. The elongate extension first end 38 has a first generally square extension 40 complementary to the first tubular handle square hole. The elongate extension second end 42 has a second generally square extension 44 complementary to the first tubular handle square hole 22 for detachable connection thereto. An alignment spike 46 has two opposite ends, a first conical end 48 and a second generally square extension 50 complementary to the first tubular handle square hole 22 for detachable connection thereto.

In FIG. 2, the socket wrench apparatus is illustrated and will be described. More particularly, the socket wrench apparatus 10 has the first ratchet head 12 having the first ratchet mechanism 14 therein and the first rotatable generally rectangular drive 16 outwardly extending from the first ratchet mechanism 14. The first ratchet head 12 is ⅜ inch standard drive. The first ratchet head 12 is comprised of tool steel. The first tubular handle 18 is connected to the first 20 ratchet head 12. The first tubular handle 18 terminates at the first free distal end 20. The first free distal end 20 has the square hole therein 22. The elongate extension 36 has the first end 38 and the second end 42. The elongate extension first end 38 has the first generally square extension 40 complementary to the first tubular handle square hole. The elongate extension second end 42 has the second generally square extension 44 complementary to the first tubular handle square hole 22 for detachable connection thereto.

Figure 4:
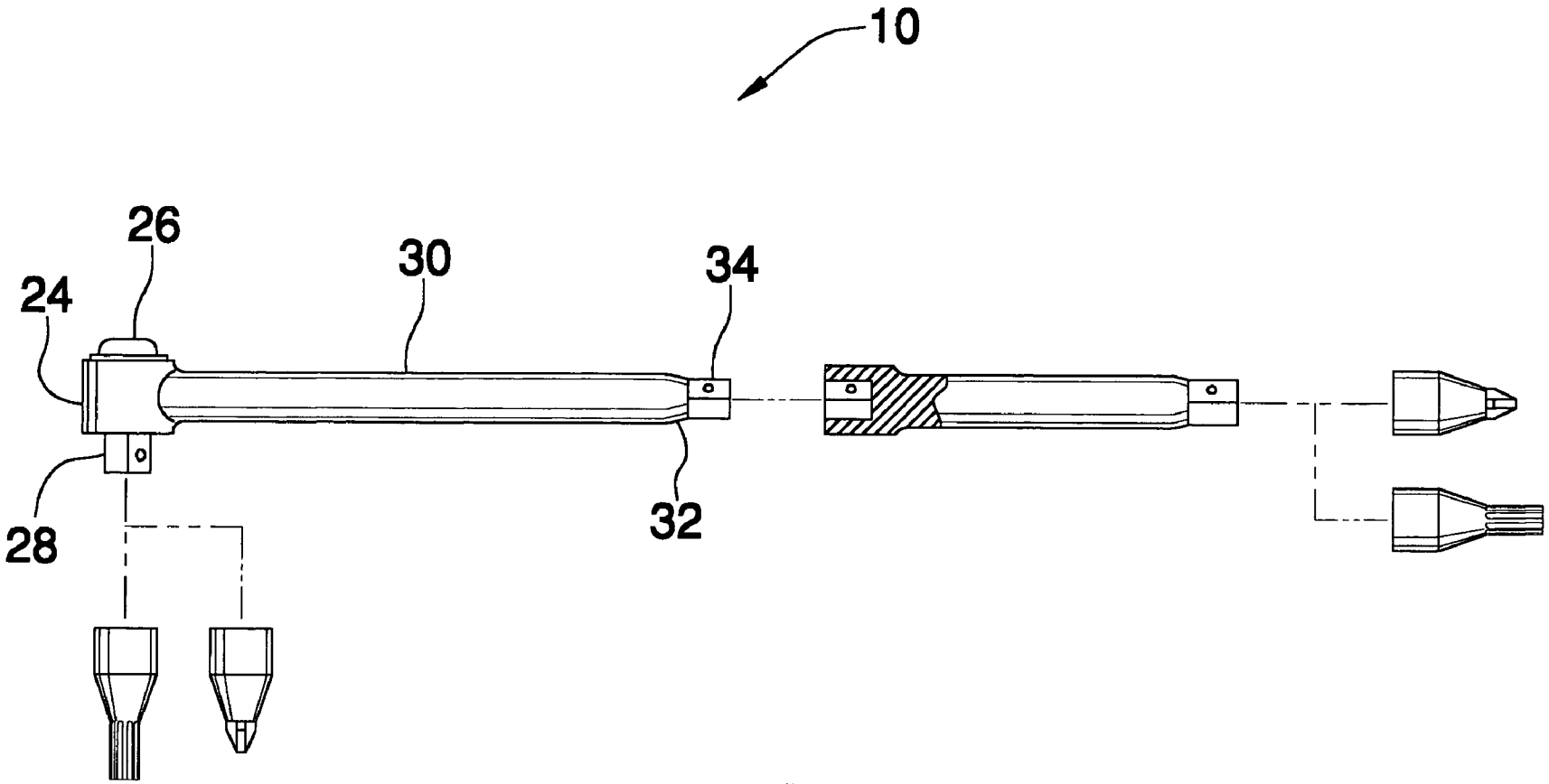
FIG. 4 is a right side view of the socket wrench apparatus of the present embodiment of the invention.

In FIG. 4, the socket wrench apparatus is illustrated and will be described. More particularly, the socket wrench apparatus 10 has the first ratchet head 12 having the first ratchet mechanism 14 therein and the first rotatable generally rectangular drive 16 outwardly extending from the first ratchet mechanism 14. The first ratchet head 12 is ⅜ inch standard drive. The first 30 ratchet head 12 is comprised of tool steel. The first tubular handle 18 is connected to the first ratchet head 12. The first tubular handle 18 terminates at the first free distal end 20. The first free distal end 20 has the square hole therein 22. Additional attachments may be detachably attached to the first rotatable generally rectangular drive 16.

In use, it can now be understood that either the elongate extension 36 or the second tubular handle generally square extension 34 is inserted into the first tubular handle first free distal end square hole.

While a preferred embodiment of the socket wrench apparatus has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present embodiment of the invention. For example, any suitable metal such as stainless steel may be used instead of the tool steel described.

Therefore, the foregoing is considered as illustrative only of the principles of the embodiment of the invention. Further, since numerous modifications and changes will readily occur to those skilled in the art, it is not desired to limit the embodiment of the invention to the exact construction and operation shown and described, and accordingly, all suitable modifications and equivalents may be resorted to, falling within the scope of the embodiment of the invention.

We claim:

1. A socket wrench apparatus comprising:

a first ratchet head having a first ratchet mechanism therein and a first rotatable generally rectangular drive outwardly extending from said first ratchet mechanism;

a first tubular handle connected to said first ratchet head, said first tubular handle terminating at a first free distal end, said first free distal end having a square hole therein; and a second ratchet head having a second ratchet mechanism therein and a second rotatable generally rectangular drive outwardly extending from said second ratchet mechanism; and a second tubular handle connected to said second ratchet head, said second tubular handle terminating at a second free distal end, said second free distal end having a generally square extension complementary to said first tubular handle square hole for detachable connection thereto.

2. A socket wrench apparatus comprising:

a first ratchet head having a first ratchet mechanism therein and a first rotatable generally rectangular drive outwardly extending from said first ratchet mechanism;

a first tubular handle connected to said first ratchet head, said first tubular handle terminating at a first free distal end, said first free distal end having a square hole therein; and an alignment spike having two opposite ends, a first conical end and a second generally square extension complementary to said first tubular handle square hole for detachable connection thereto.

3. A socket wrench apparatus comprising:

a first ratchet head having a first ratchet mechanism therein and a first rotatable generally rectangular drive outwardly extending from said first ratchet mechanism;

a first tubular handle connected to said first ratchet head, said first tubular handle terminating at a first free distal end, said first free distal end having a square hole therein;

a second ratchet head having a second ratchet mechanism therein and a second rotatable generally rectangular drive outwardly extending from said second ratchet mechanism;

a second tubular handle connected to said second ratchet head, said second tubular handle terminating at a second free distal end, said second free distal end having a generally square extension complementary to said first tubular handle square hole for detachable connection thereto; and an elongate extension having a first end and a second end, said extension first end having a generally square extension complementary to said first tubular handle square hole, said extension second end having a generally square extension complementary to said first tubular handle square hole for detachable connection thereto.

4. The socket wrench apparatus of claim 3 further comprising:

an alignment spike having two opposite ends, a first conical end and a second generally square extension complementary to said first tubular handle square hole for detachable connection thereto.

5. The socket wrench apparatus of claim 4 wherein:

said first ratchet head is ⅜ inch standard drive.

6. The socket wrench apparatus of claim 4 wherein:

said first ratchet head is ½ inch standard drive.

7. The socket wrench apparatus of claim 4 wherein:

said first ratchet head is ¾ inch standard drive.

8. The socket wrench apparatus of claim 4 wherein:

said first ratchet head is 1 inch standard drive.

9. The socket wrench apparatus of claim 4 wherein:

said first ratchet head is comprised of tool steel.

10. The socket wrench apparatus of claim 4 wherein:

said first ratchet head is comprised of stainless steel.

* * * * *